US005655551A

United States Patent [19]

Knight

[11] Patent Number: 5,655,551

[45] Date of Patent: Aug. 12, 1997

[54] METHOD OF USE OF AN APPLICATOR TOOL FOR HAIRDRESSING LOTIONS AND THE LIKE

[76] Inventor: Lois A. Knight, 9818 Reliance Dr, Anchorage, Ak. 99507

[21] Appl. No.: 523,155

[22] Filed: Sep. 5, 1995

Related U.S. Application Data

[63] Continuation-in-part of Ser. No. 212,983, Mar. 15, 1994, abandoned.

[51] Int. Cl.[6] ..... A45D 24/00

[52] U.S. Cl. ..... 132/200; 132/150; 132/125; 132/901; 132/207; 132/212

[58] Field of Search ..... 132/120, 121, 132/129, 125, 148, 150, 212, 219, 901, 107, 200

[56] References Cited

U.S. PATENT DOCUMENTS

| | | | |
|---|---|---|---|
| 2,201,753 | 5/1940 | Wolkow | 132/150 |
| 2,577,921 | 12/1951 | Samel et al. | 132/148 |
| 2,602,457 | 7/1952 | Mele | 132/150 |
| 4,011,879 | 3/1977 | Roberts | 132/212 |
| 4,388,936 | 6/1983 | Roberts | 132/212 |
| 5,042,512 | 8/1991 | Knight | 132/219 |
| 5,533,537 | 7/1996 | Mourad | 132/148 |

*Primary Examiner*—Gene Mancene
*Assistant Examiner*—Pedro Philogene
*Attorney, Agent, or Firm*—Michael J. Tavella

[57] ABSTRACT

A method of use of an applicator for hair lotions. The applicator has a flat, solid blade that is shaped like a comb. This blade does not have teeth like a comb normally has. One embodiment of the applicator does have a series of small curved teeth, similar in appearance to saw teeth, formed on the front edge of the blade. These teeth enable the applicator to lie flat on coarse hair without difficulty compared to an applicator having a smooth leading edge. The method calls for aligning the front edge of the blade against the hair such that the flat blade is perpendicular to the hair; applying lotion to the hair; catching any spilled lotion on the flat blade of the applicator; rotating the flat blade 90 degrees such that the blade is parallel to the hair; and wiping the lotion accumulated on the flat blade on the hair.

2 Claims, 4 Drawing Sheets

METHOD OF USE OF AN APPLICATOR TOOL FOR HAIRDRESSING LOTIONS AND THE LIKE

RELATED APPLICATIONS

This application is a continuation-in-part of application Ser. No. 08/212,983, filed Mar. 15, 1994, now abandoned.

This invention relates to the method if use of applicators for hairdressing lotions and more particularly to comb-like implements having a generally smooth body and a rat-tail handle.

BACKGROUND OF THE INVENTION

This invention is a method of use of an applicator tool for hairdressing lotions. Two types of applicator tools are disclosed in the application, although the method of use is identical. The first tool is disclosed in U.S. Pat. No. 5,042,512 to Knight. The disclosure therein is incorporated herein by reference. The second type of applicator tool is discussed below.

The Knight applicator used a smooth, rectangular, flat blade to apply hairdressing lotions to hair. The tool also had a rat-tail handle that is useful in the types of styling that uses the applicator. The applicator is used to catch lotion that seeps through the hair during the treatment process and then, the applicator is used like a palette knife to spread caught lotion over the curlers. The flat blade holds the lotion as compared to an ordinary comb that lets it leak through.

In cases of thick, coarse hair, the perfectly straight edge of the original Knight blade does not make good contact with the hair. It creates voids that allow the lotion to leak past the blade.

SUMMARY OF THE INVENTION

To correct the problem of the original applicator with course hair, two new designs have been developed. In the first, a small row of teeth have been added to the front edge. These teeth are more like the teeth of a saw rather than a comb. These teeth are designed to create an uneven edge that can pass over the surface of coarse hair, preventing the hair from riding up and keeping it smooth. The second design uses teeth similar to those found on a comb, except they are shorter. These teeth operate by slightly penetrating the hair, thereby eliminating any voids between the applicator and the hair. As in the case of the first design, this applicator also keeps the coarse hair from riding up. Short teeth permit the device to pass over and smooth the hair without irritating the scalp.

The use of this tool is novel. Typical combs are used to separate hair and to pull hair to make it smooth. In hair processing techniques such as perms of other chemical treatments, pulling the hair is dangerous. When the hair is under chemical treatment, it cannot be pulled. Otherwise, the hair may be damaged or even pulled out of the scalp. In applying the lotions for these treatments, speed is important. Many lotions require application within a five to ten minute period. Such time pressure usually results in a lot of chemical being applied to the hair in a sloppy manner. This wastes the product, which often spills off the hair. The instant invention minimizes loss of product because it catches the chemical as it falls from the hair. The chemical lotion thus caught, can be then reapplied to the hair both saving product and reducing treatment time.

The device is used by placing the blade against the hair so that the blade is perpendicular to the hair with the front edge of the flat blade touching the hair. The chemical lotion is then applied and allowed to fall onto the flat blade of the device. When the chemical is on the blade, the blade is rotated 90° and the chemical can then be wiped onto the hair. By repeating these steps, the chemical can be applied to the hair uniformly and in a timely manner with minimum waste.

DETAILED DESCRIPTION OF THE INVENTION

Figure 1:
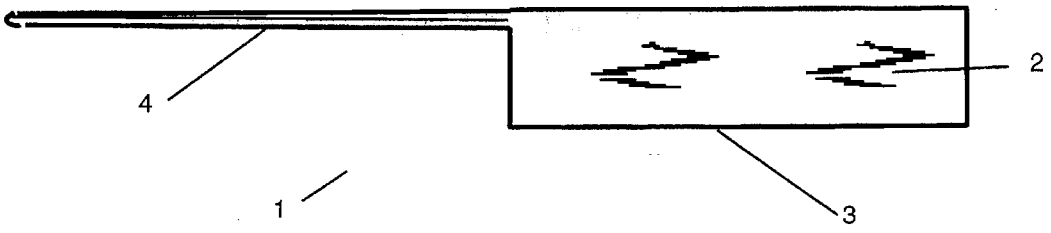
Figure 1 Prior Art
FIG. 1 is a side view of the original Knight design.
Figure 2:
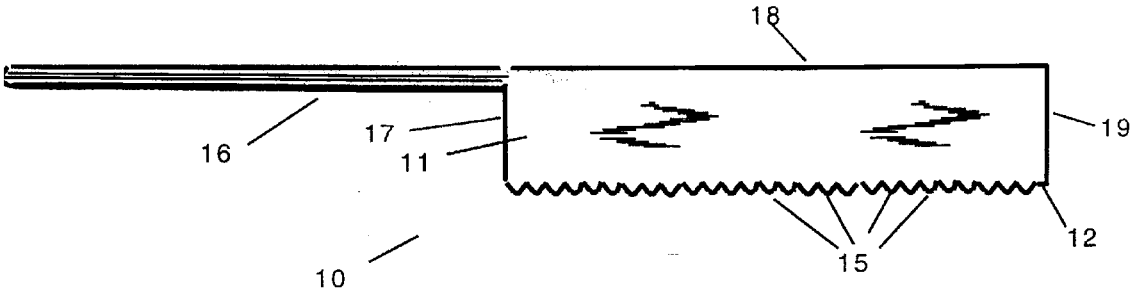
FIG. 2 is a side view of the first embodiment of the new applicator.
Figure 3:
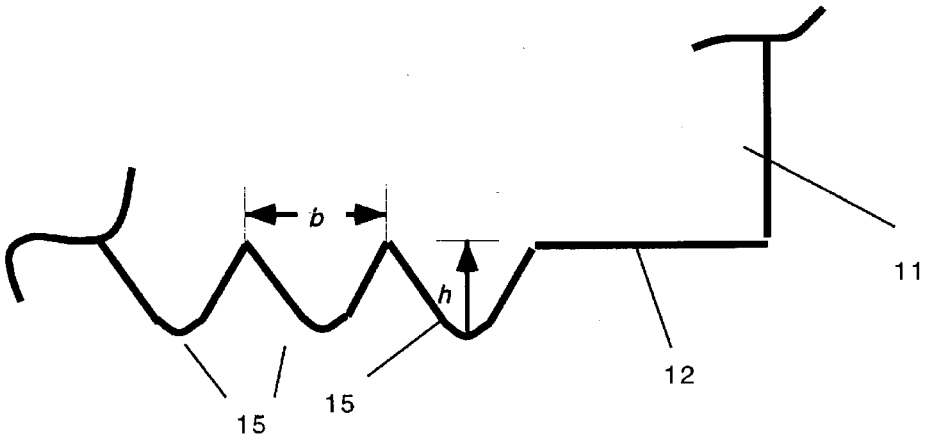
FIG. 3 is a detail view of the teeth formed in the lower edge of the blade of the first embodiment of the new applicator.

FIG. 1 is a side view of the original design 1, as disclosed in U.S. Pat. No. 5,042,512. It has a rectangular blade portion 2 that has smooth edges, including a smooth front edge 3. This design also has a rat-tail handle 4. FIG. 2 is a side view of the first embodiment of the new applicator 10. It has a rectangular blade portion 11 that has smooth edges, 17, 18, and 19 and a front edge 12, which has a number of equally spaced teeth 15. These teeth are not separated as in an ordinary comb. Rather, they are similar to teeth found on a saw. These teeth are designed to permit the front edge 12 of the device to maintain close contact with coarse hair. FIG. 3 shows a detail view of the teeth 15. These teeth 15 are rounded to prevent injury during use. As the drawing illustrates, the teeth are not open like those found in an ordinary comb. These teeth 15 are not designed to penetrate the hair deeply to separate the hair. Rather their function is to enable the front edge 12 of the blade to maintain a close fit when passing over coarse hair and to keep the front edge from pushing the hair upwards. In this embodiment, the teeth have a height h and a base b, as shown in FIG. 2. Both the height and the base are approximately ⅜ inches long. FIG. 2 also shows that the applicator 10 has a rat-tail end 16 as shown in this design, the rat tail 16 is a tapered cylinder that has a diameter at its widest point of about ⅜ inches.

Figure 4:
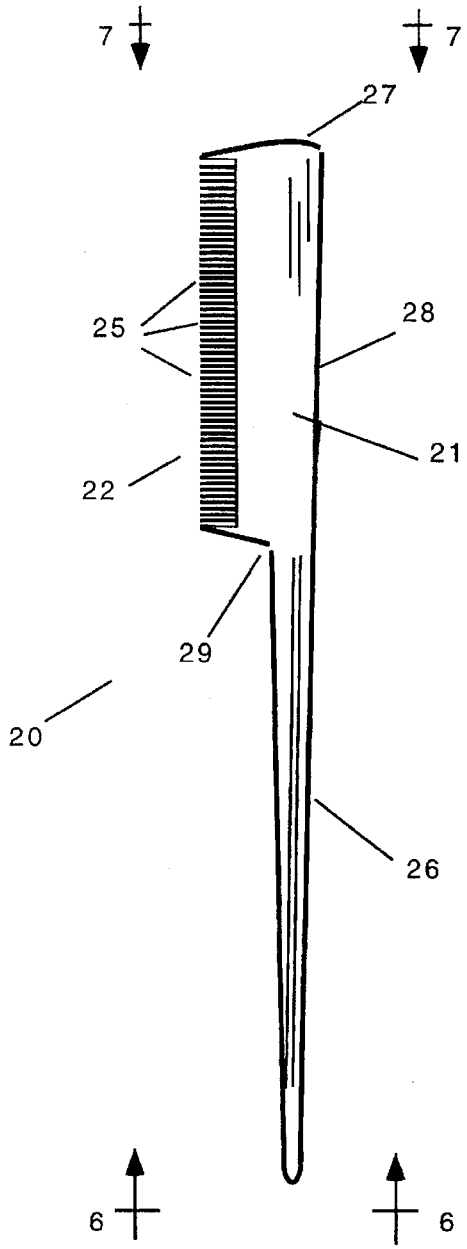
FIG. 4 is a side view of the second embodiment of the new applicator.
Figure 5:
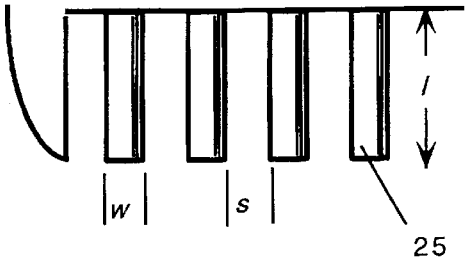
FIG. 5 is a detail view of the teeth formed in the lower edge of the blade of the second embodiment of the new applicator.

Referring now to FIG. 4, a second embodiment of new applicator is shown. Here, the applicator 20 has a rectangular blade portion 21 that has smooth edges 27, 28 and 29, and a front edge 22. Here, the front edge 22 has a number of equally spaced teeth 25. These teeth 25 are separated and are similar to those found in an ordinary comb. However, unlike a comb, the teeth 25 are short and stubby. These teeth are also designed to permit the front edge 22 of the device to maintain close contact with coarse hair. FIG. 5 shows a detail view of the teeth 25 on the second embodiment 20. These teeth 25 are not designed to penetrate the hair deeply to separate the hair. Rather their function is to enable the front edge 22 of the blade to maintain a close fit when passing over coarse hair. In this embodiment, the teeth 25 also have a length 1 of ⅜ inches, a width w of 1/32 inches, and are spaced apart s approximately 1/32 inches. As shown in FIG. 4, the teeth 25 at both ends of the row have a slight taper and are wider than the center teeth. In this embodiment, the preferred number of cylindrical teeth 25 is 48. The total number of teeth is 50. FIG. 4 also shows that this embodiment has a rat-tail end 26 as shown. In this design, the rat tail 26 is a tapered cylinder that has a diameter at its widest point of about ⅜ inches.

Figure 6:
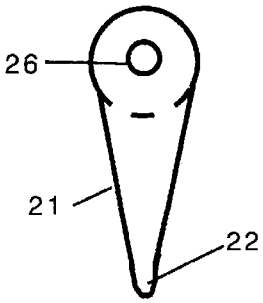
FIG. 6 is an end view of the new applicator taken along the lines 6—6 of FIG. 4.
Figure 7:
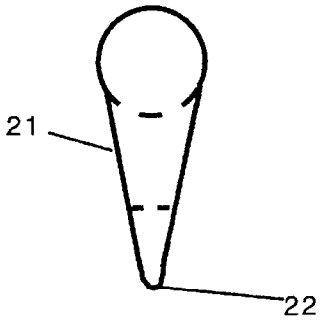
FIG. 7 is an end view of the new applicator taken along the lines 7—7 of FIG. 4.

FIGS. 6 and 7 show that the blade portion of both embodiments of the applicators is tapered from top to bottom.

Both embodiments of this device are used in the same manner as that of the original. The flat blade is used to direct the flow of lotion over the hair. In these embodiments, however, the teeth are used to assist in passing over coarse hair.

The invention can be made from any material common to the art. Typically thermoplastic can be used, but stainless steel may also be used if desired. Again, any ordinary material used in making combs may be used with this design.

Figure 8:
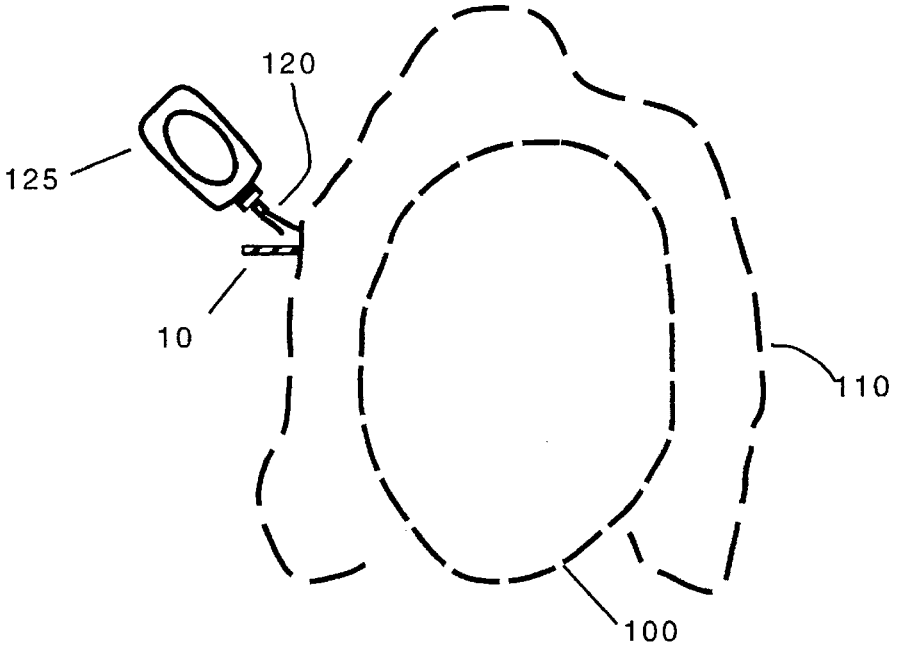
FIG. 8 is a detail view of a person being treated with the invention; the invention being in the collecting position.
Figure 9:
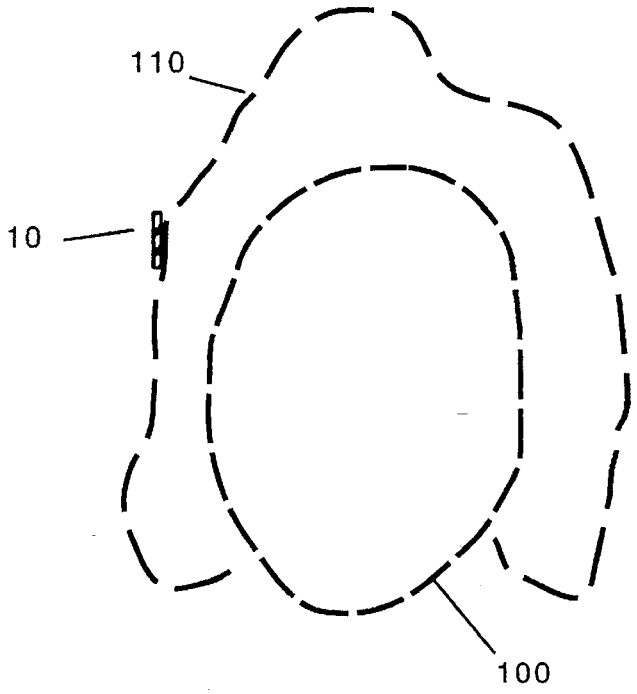
FIG. 9 is a detail view of a person being treated with the invention; the invention being in the applying position.

Referring now to FIG. 8, a person 100 is shown with hair 110, ready to receive the appropriate lotions. The applicator 10 is placed perpendicularly against the hair 110 as shown. The lotion 120 is applied from a bottle 125 as shown. As the lotion is dispensed, any lotion 120 not absorbed in the hair 110 slides down onto the flat blade of the applicator 10. Referring to FIG. 9, once the lotion 120 has been applied to the hair 110, the excess lotion 120 now on the blade of the applicator 10 can be applied to the hair 110 by rotating the applicator 10 ninety degrees until it is parallel to the hair 110 as shown in FIG. 9. The lotion 120 can then be smoothed into the hair 110 using the blade by lightly wiping the blade against the hair 110. This process can be repeated as many times as needed until all of the hair 110 has been treated. This method eliminates waste and allows the lotion to be applied in a fast, efficient mariner.

Figure 10:
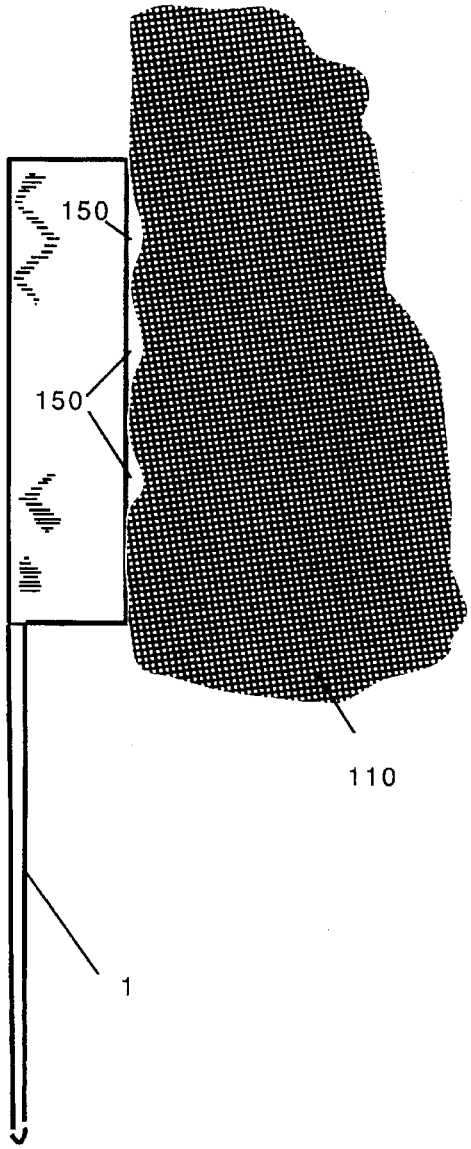
Figure 10 Prior Art
FIG. 10 is a top detail view of the original applicator against coarse hair.
Figure 11:
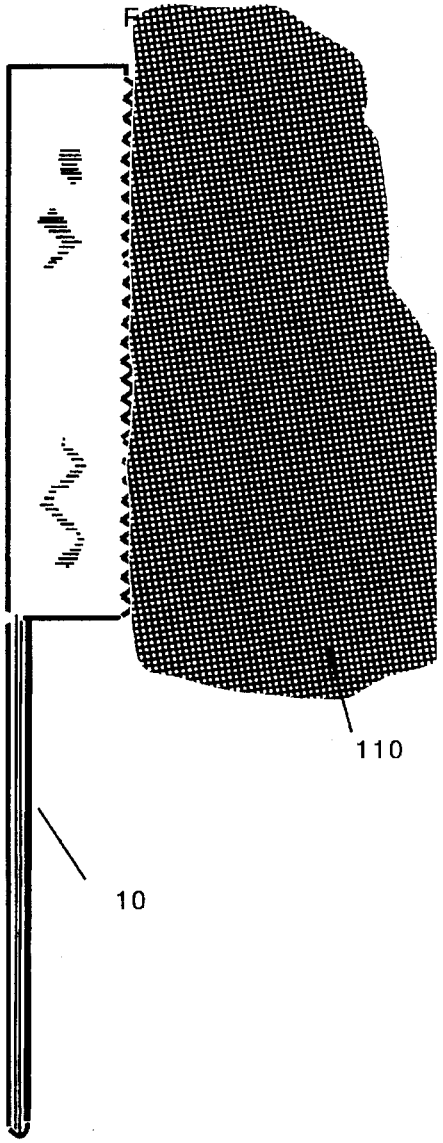
FIG. 11 is a top detail view of the new applicator against coarse hair.

Referring now to FIGS. 10 and 11, details of the applicators are shown in use on course hair 110. FIG. 10 is a top detail view of hair 110. In this view, the original applicator 1 is shown. Because the front edge 3 of the applicator 1 is straight, it cannot sit flat against the thicker course hair 110. This condition creates voids 150 between the hair 110 and the applicator 1. Note that the voids 150 as shown in FIG. 10 are exaggerated for clarity. FIG. 11 shows the same hair 110 but with the first embodiment of the new applicator 10. Here, the teeth 15 work into the hair 110, thereby bringing the front edge 12 of the applicator 10 tightly against the hair 110. This eliminates any voids and ensure minimum waste of the lotion.

The present disclosure should not be construed in any limited sense other than that limited by the scope of the claims having regard to the teachings herein and the prior art being apparent with the preferred form of the invention disclosed herein and which reveals details of structure of a preferred form necessary for a better understanding of the invention and may be subject to change by skilled persons within the scope of the invention without departing from the concept thereof.

I claim:

1. A method of applying lotion to hair using an applicator having a flat blade having a front edge, comprising the steps of:

a) aligning the front edge of the flat blade against the hair such that the flat blade is perpendicular to the hair;

b) applying lotion to the hair;

c) catching any spilled lotion on the flat blade;

d) rotating the flat blade 90 degrees such that the flat blade is parallel to the hair; and e) wiping the lotion accumulated on the flat blade on the hair.

2. A method of applying lotion to hair using an applicator having a flat blade having a front edge, and also having a plurality of teeth extending outwardly from said front edge, comprising the steps of:

a) aligning the front edge of the flat blade against the hair such that the flat blade is perpendicular to the hair and plurality the teeth rest against the hair, thereby closing any voids between the hair and the front edge of the flat blade;

b) applying lotion to the hair;

c) catching any spilled lotion on the flat blade;

d) rotating the flat blade 90 degrees such that the flat blade is parallel to the hair; and e) wiping the lotion accumulated on the flat blade on the hair.

* * * * *